United States Patent [19]

Lawson

[11] Patent Number: 5,018,377

[45] Date of Patent: May 28, 1991

[54] HOT ROLLING OF METAL STRIP

[75] Inventor: Kenneth T. Lawson, Yorkshire, England

[73] Assignee: Dave McKee (Sheffield) Limited, Yorkshire, England

[21] Appl. No.: 430,667

[22] Filed: Nov. 2, 1989

[30] Foreign Application Priority Data

Nov. 3, 1988 [GB] United Kingdom ..... 8825714

[51] Int. Cl.[5] ..... B21B 37/04

[52] U.S. Cl. ..... 72/12; 72/14; 72/17; 72/205

[58] Field of Search ..... 72/8, 9, 11, 12, 17, 72/18, 205, 14

[56] References Cited

U.S. PATENT DOCUMENTS 3,782,155 1/1974 Bald ..... 72/14

FOREIGN PATENT DOCUMENTS 0122607 9/1980 Japan ..... 72/10
0117812 9/1981 Japan ..... 72/10
56-160819 12/1981 Japan ..... 72/8
58-167015 10/1983 Japan ..... 72/9
58-218313 12/1983 Japan ..... 72/9
60-18213 1/1985 Japan ..... 72/8
0106622 6/1985 Japan ..... 72/14

*Primary Examiner*—Lowell A. Larson
*Assistant Examiner*—Thomas C. Schoeffler
*Attorney, Agent, or Firm*—Lee, Mann, Smith, McWilliams & Sweeney

[57] ABSTRACT

When hot rolling metal strip, it is usual to apply tension to the strip and then a contact-type strip tension detector is employed to detect variations in tension across the width of the strip. The signals are used to adjust the rolling mill in the sense to reduce shape variations across the width substantially to zero. Until tension has been applied to the leading end of the strip, the contact-type detector cannot be used. Consequently, the strip may be of bad shape. The invention resides in employing a non-contact type strip shape detector to detect variation in shape and adjust the rolling mill until tension has been applied to the strip.

5 Claims, 1 Drawing Sheet

HOT ROLLING OF METAL STRIP

Figure 1:
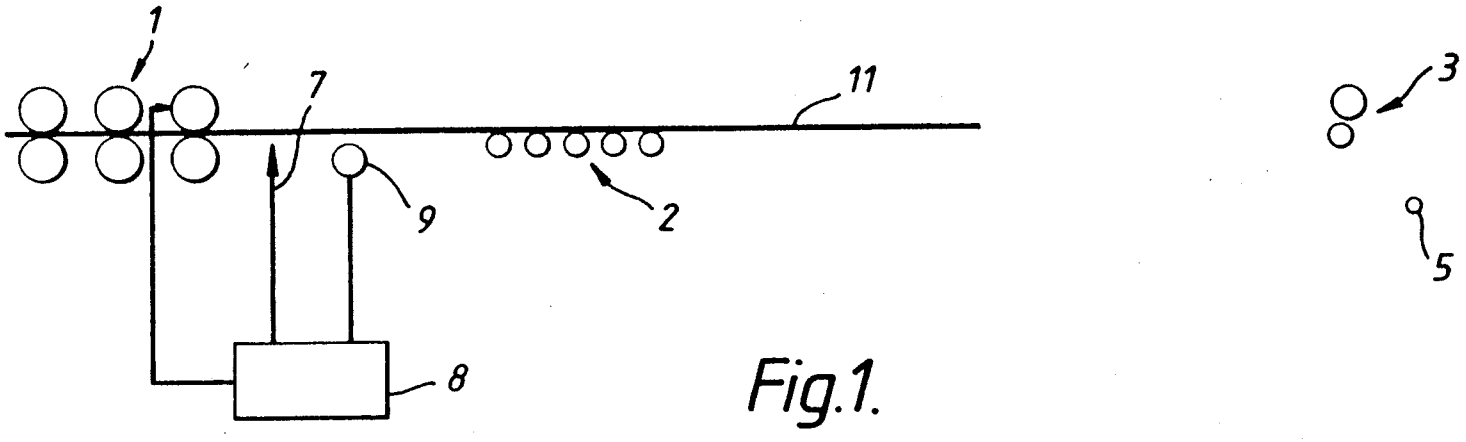

This invention relates to the rolling of hot metal strip. It is well known to control the shape of metal strip issuing from the last stand of a rolling mill by first detecting variations in tension at regions spaced apart across its width and then controlling one or more parameters of one or more of the mill stands in order to reduce the variation in tension. The variation in tension in the strip at regions across its width indicates the shape of the strip.

A well known device for detecting strip tension at regions across the width of the strip is sold under the Trade Mark VIDIMON by Davy McKee (Poole) Limited, Wallisdown Road, Poole, Dorset BH12 5AG, England. This device comprises a plurality of cylindrical rollers arranged end-to-end and rotatable about a common axis. In use, the device is positioned with the common axis substantially at right angles to the direction of movement of the strip and is urged towards the strip so that part of the periphery of each roller is in contact with a separate longitudinally extending part of the metal strip. Each roller has a transducer associated with it for detecting the pressure applied to the roller by the part of the strip which engages it. This is a measure of the tension in that part of the strip.

However, in the case of a modern hot strip mill, such a device is inoperative until the leading end of the strip being rolled has passed along a run-out table and has been engaged by a pair of pinch rolls or a coiler in order to apply longitudinal tension. This means that adjustments to one or more of the stands of the rolling mill in order to correct for bad shape cannot be made until a length of strip of a significant length has been rolled and this length of strip usually has to be subsequently removed from the rolled strip and scrapped.

An object of the present invention is to provide a method of rolling metal strip in which this difficulty is overcome.

According to the present invention, in a method of rolling hot metal strip, the leading end of the strip issuing from the last stand of a multi-stand hot rolling mill is passed along a run-out table and is brought into engagement with means which apply longitudinal tension to the portion of the strip between said means and the last stand of the rolling mill; and, until the longitudinal tension is applied to the strip, a non-contact type of strip shape detector is employed adjacent to, and downstream of, the last stand to detect variations in shape across the width of the metal strip and to produce signals representative of said variations; and, when longitudinal tension is applied to the strip, a contact-type of strip tension detector is employed adjacent to, and downstream of, the last stand to detect variations in tension across the width of the strip and to produce signals representative of said variations, said signals being employed, in turn, to adjust the rolling parameters of one or more stands of the rolling mill in the sense to reduce shape variations across the width of the strip substantially to zero.

Longitudinal tension may be applied to the strip by passing the strip into a gap between a pair of pinch rolls, closing the rolls on to the strip and rotating at least one of the rolls with a greater peripheral speed than the linear speed of the strip issuing from the last stand.

Alternatively, the longitudinal tension may be applied by engaging the leading end of the strip with a rotary coiler and rotating the coiler at a peripheral speed which coils the strip on to the coiler and also applies longitudinal tension to the strip.

As a result of the present invention, steps can be taken to correct the shape of the leading end of the strip, if necessary, before the strip has longitudinal tension exerted on it.

It should be noted that, when the strip is not under tension, it can exhibit bad shape, such as wavy edges, which can be detected by the non-contact shapemeter. However, when the strip is under tension, these waves may disappear and inherent bad shape, which would only re-appear under zero tension conditions, cannot be deduced by the non-contact shapemeter and can only be deduced from measurements of tension variation obtained by the contact-type shapemeter.

Figure 2:
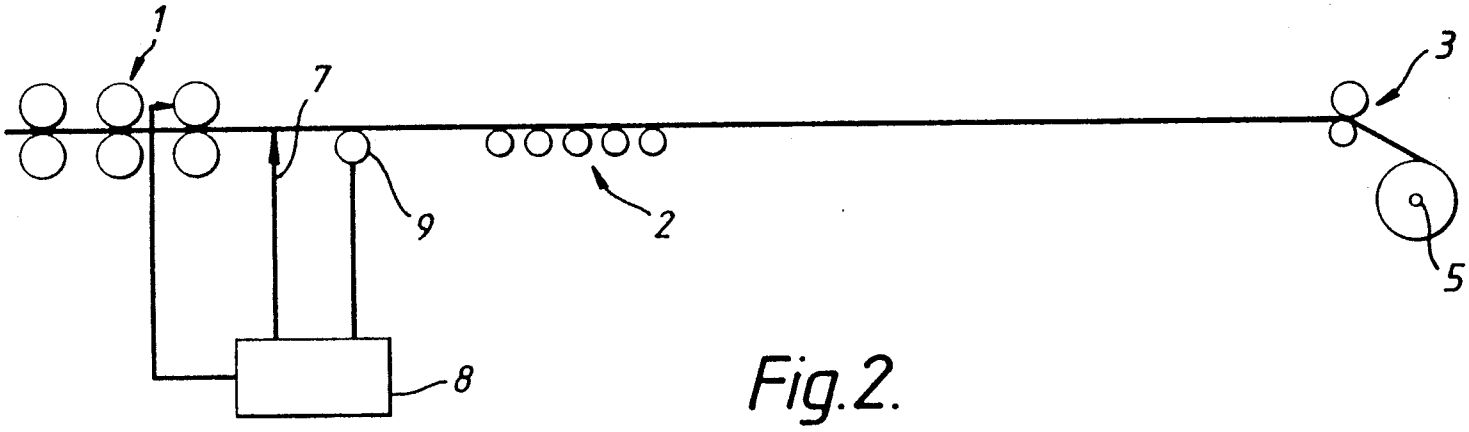

In order that the invention may be more readily understood, it will now be described, by way of example only, with reference to the accompanying drawings, in which:

FIG. 1 diagrammatically shows the leading end of a metal strip leaving the last stand of a multi-stand roling mill; and FIG. 2 diagrammatically shows the strip after it has been connected to a coiler.

A multi-stand hot strip rolling mill is indicated generally by reference numeral 1. Downstream of the last stand there is a run-out table 2 leading to a deflector roll unit 3 and a down coiler 5. Also positioned downstream of the last stand of the mill, but close thereto, are a non-contact shapemeter 7 and a contact-type tension measuring device 9. The shapemeter 7 may be of the type known as a "Lasershape" and sold by SPIE-TRINDEL of 1, rue de la Champagnerie, 57270 Uckange, France. This device employs laser beams and optical triangulation devices to measure, without contact, the vertical location of a plurality of points across the width of the strip with respect to a reference plane. The device 9 may be a VIDIMON-type shapemeter.

Referring to FIG. 1, the leading end of a metal strip issuing from the rolling mill is shown passing down the run-out table towards the coiler 5. At this time there is no longitudinal tension in the strip. The shapemeter 7 is employed to detect variations in shape across the width of the strip and the signals from the shapemeter are supplied to a control circuit indicated generally by reference 8. In this control circuit the signals from the shapemeter are used to determine the shape variation of the strip 11 and signals are supplied from the control circuit 8 to adjust the roll parameter of one or more of the stands of the rolling mill 1 in the sense to reduce the shape variations substantially to zero. Thus, the amount of strip which is rolled with "bad shape" is reduced. When the leading end of the strip reaches the roll unit 3 it is deflected to the coiler 5 where it is held in engagement with the the coiler drum and the drum is then accelerated to coil the strip on to the drum and to produce longitudinal tension in the length of strip between the last stand and the coiler.

The shapemeter 7 is no longer employed to determine the shape of the strip and the tension measuring device 9 is brought into contact with the moving strip to detect variations in tension across the width of the strip. This is the situation shown in FIG. 2. Signals from the device 9 are supplied to the control circuit 8 instead of signals from the shapemeter 7 and, again, the control ciruit compares the tension variation across the width of the strip and supplies signals to control the settings of one or more stands in the mill in the sense to reduce the tension variation across the width of the strip substantially to zero and, hence, improve the shape of the strip.

An arrangement for adjusting the rolling parameters of one or more stands of a rolling mill under the control of signals from a shapemeter is disclosed in British Patent No. 2017974.

In order to improve the shape of the strip, one course of action which can be undertaken is to incline one roll of the pair of work rolls of the last stand of the mill in the vertical plane with respect to the other work roll so that the gap between the two rolls is tapered along its length. Alternatively, the shape of the gap between the two work rolls of the last stand can be adjusted by applying bending forces to one or both of the rolls. An alternative arrangement for adjusting the shape of the gap is to apply non-uniform cooling along the length of one or both of the work rolls of the last stand. Liquid coolant is usually applied by sprays and, by non-uniform spraying on to the rolls, non-uniform expansion of the rolls takes place and the shape of the gap between the rolls is altered. Any one or any combination of these alternative arrangements may be employed.

I claim:

1. A method of rolling hot metal strip in which the leading end of the strip issuing from between the work rolls of the last stand of a multi-stand hot rolling mill is passed along a run-out table; comprising the steps of first employing a non-contact-type of strip shape detector adjacent to, and downstream of, the last stand to detect variations in shape across the width of the metal strip and to produce first signals representative of said variations across the width of the strip; employing said first signals to adjust the gap between the work rolls of at least one of the stands of the rolling mill in the sense to reduce shape variation across the width of the strip substantially to zero; bringing said leading end of the strip into engagement with means located remote from the rolling mill to apply longitudinal tension to the portion of the strip between said means and the last stand of the rolling mill; then discontinuing employment of said non-contact-type of strip shape detector and employing a contact-type strip tension detector adjacent to, and downstream of, the last stand to detect variations in shape across the width of the actual strip and to produce second signals representative of said variations across the width of the strip; and employing said second signals instead of said first signals to adjust the gap between the work rolls of at least one of the stands of the rolling mill in the sense to reduce shape variations across the width of the strip substantially to zero.

2. A method as claimed in claim 1, in which longitudinal tension is applied to the strip by passing the strip into a gap between a pair of pinch rolls, closing the rolls on to the strip and rotating at least one of the rolls with a greater peripheral speed than the linear speed of the strip issuing from the last stand.

3. A method as claimed in claim 1, in which longitudinal tension is applied to the strip by engaging the leading end of the strip with a rotary coiler and rotating the coiler at a peripheral speed which coils strip on the coiler and applies longitudinal tension to the strip.

4. A method as claimed in claim 1, in which the cross-section of the gap is adjusted by inclining one roll relative to the other, and/or by bending one or both of the rolls, and/or by non-uniform cooling of the rolls.

5. A method as claimed in claim 4, in which the first and second signals are employed to adjust the cross-section of the gap between the work rolls of the last stand.

* * * * *